United States Patent [19]

Wichmann

[11] Patent Number: 4,811,027

[45] Date of Patent: Mar. 7, 1989

[54] BROAD-BAND DIRECTIONAL ANTENNA

[75] Inventor: Gunter Wichmann, Leimen, Fed. Rep. of Germany

[73] Assignee: Eltro GmbH, Heidelberg, Fed. Rep. of Germany

[21] Appl. No.: 826,276

[22] Filed: Feb. 5, 1986

[30] Foreign Application Priority Data

Feb. 6, 1985 [DE] Fed. Rep. of Germany ..... 3503990

[51] Int. Cl.[4] ..... H01Q 13/02

[52] U.S. Cl. ..... 343/776

[58] Field of Search ..... 343/776–778, 343/786, 841; 342/375

[56] References Cited

U.S. PATENT DOCUMENTS

| | | | |
|---|---|---|---|
| 2,297,202 | 9/1942 | Dallenbach et al. | 343/786 |
| 2,454,766 | 11/1948 | Brillouin | 343/786 |
| 2,591,486 | 4/1952 | Wilkinson | 343/786 |
| 2,751,586 | 6/1956 | Riblet | 343/776 |
| 2,897,491 | 7/1959 | Young | 343/776 |
| 2,946,999 | 7/1960 | Kelleher et al. | 343/786 |
| 2,998,602 | 8/1961 | Cacheris | 343/779 |
| 3,346,068 | 10/1967 | Woods et al. | 367/61 |
| 3,611,396 | 10/1971 | Jones | 343/776 |
| 3,860,933 | 1/1975 | Terakawa et al. | 343/771 |
| 3,882,505 | 5/1975 | Mailloux | 343/776 |
| 3,938,160 | 2/1976 | Mailloux et al. | 343/778 |
| 4,447,811 | 5/1984 | Hamid | 343/786 |

FOREIGN PATENT DOCUMENTS

| | | | |
|---|---|---|---|
| 1516756 | 6/1969 | Fed. Rep. of Germany . | |
| 135113 | 5/1960 | U.S.S.R. | 343/776 |

OTHER PUBLICATIONS

IEEE Transactions on Geoscience & Remote Sensing, vol. GE-21, #2, 4/83, pp. 201–207.

TEM Horn Antenna: Input Reflection Characteristics in Transmission by Evans et al, IEEE Proc., vol. 130, Pt. H, No. 6, Oct. 1983.

Broadband Pulse-Optimised Antenna by Theodorou et al, IEEE Proc., vol. 128, Pt. H, No. 3, Jun. 1981.

*Primary Examiner*—William L. Sikes

*Assistant Examiner*—Michael C. Wimer

*Attorney, Agent, or Firm*—Michael N. Meller

[57] ABSTRACT

A directional antenna is provided having an array of directional antenna elements arranged in at least one row. The directional antenna elements are activated in accordance with a predetermined pattern. The signal amplitudes on the receiving side are time-shifted to simulate a low-frequency signal for detection of deeper-lying anti-tank mines. Each directional antenna element has a pair of flat strips which lie close to each other at the base side and which proceed in parallel before diverging to a greater width toward the aperture side.

6 Claims, 2 Drawing Sheets

FIG. 1
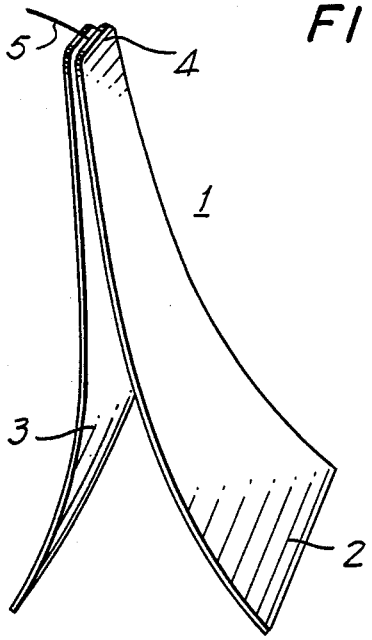
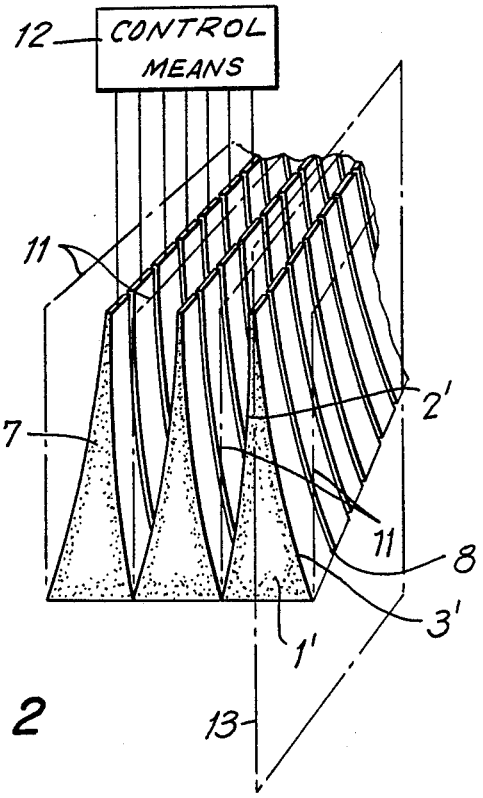
FIG. 2

BROAD-BAND DIRECTIONAL ANTENNA

FIELD OF THE INVENTION

The invention relates to a broad-band directional antenna of the horn type.

BACKGROUND OF THE INVENTION

An antenna of the aforementioned type is disclosed in French Patent Specification No. 2015415, British Patent No. 964,458 and U.S. Pat. No. 3,099,836. Such antennas have a relatively large aperture as well as, for that reason, a relatively coarse resolution. It is due to these circumstances that objects embedded in the earth of small geometric dimensions can be located. However, no exact determination can be made regarding the size, shape and position of such small objects. If, on the other hand, an antenna of small aperture is selected, only a short search pulse can be transmitted, which in the case of wet ground and correspondingly increased attenuation, cannot penetrate sufficiently deeply to detect small objects.

SUMMARY OF THE INVENTION

The object of the invention is to provide an antenna of the foregoing type for the purpose of locating small objects buried underground, wherein its geometric dimensions are substantially smaller and its resolution and depth perception are sufficiently reliable. This object is achieved in accordance with the invention by providing a directional antenna comprising an array of directional antenna elements arranged in at least one row, which antenna elements are activated in accordance with a predetermined pattern. These measures ensure that such antennas not only detect the presence of an object buried below the ground surface, but also allow conclusions about the object's position and appearance to be drawn from the geometric dimensions and the contour. In doing so, it is important to consider that the attainment of the desired resolution through sufficiently small apertures has the disadvantage that only objects lying directly below the ground surface (e.g. anti-personnel mines) can be located, not objects lying at greater depth (e.g. anti-tank mines), since for apertures of this order of magnitude, sufficiently long (i.e. low-frequency) pulses cannot be radiated in packets.

BRIEF DESCRIPTION OF THE DRAWINGS

The preferred embodiment of the invention will be described in detail with reference to the drawings, wherein:

FIG. 1 shows both flared strips of a conventional exponential strip conductor antenna;

FIG. 2 shows an inventive antenna arranged in a mosaic pattern having a plurality of rows with about 30 directional antenna elements;

DETAILED DESCRIPTION OF THE PREFERRED EMBODIMENT

Figure 3:
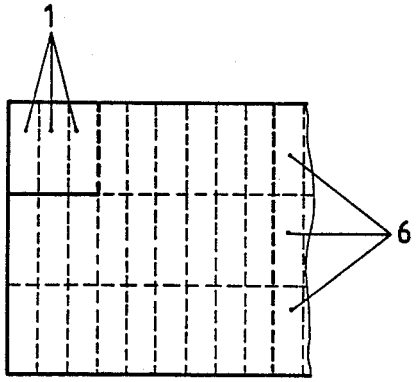
FIG. 3 shows the mosaic-shaped radiating side of the antenna according to FIG. 2.

The directional antenna 1 in FIG. 1 essentially comprises two flared strip conductors 2 and 3, which flare toward the aperture side to form a funnel shape. The base-side starting areas of the flared strip conductors 2 and 3 lie close to each other, run initially nearly parallel and are comparatively narrowly constructed. Their width increases continuously in the direction of the aperture side, as a result of which the mximal width is attained in the end area, so that the characteristic impedance increases steadily within the funnel-shaped area. When high-frequency energy is applied to the base 4 by way of coaxial line 5, pulses are radiated of width on the order of 500 psec, the amplitudes of which correspond approximately to the enveloping waveform 10 shown in FIG. 4. Inasmuch as such pulses should be radiated without errors, the total length of such an antenna should be equal to approximately 1.5 m and its aperture in both directions about 25–30 cm. To this extent the antenna conforms to the state of the art.

Although directional antennas having these dimensions radiate sufficiently long pulses—for example, such antennas penetrate sufficiently deeply for the purpose of searching for objects concealed underground—they are not suitable for all purposes. Such antennas are too bulky and have too large an aperture, due to the arrangement of many such antennas next to each other, for example, as rows of antennas across a craft, to make possible a high-definition scanning. In accordance with the invention a construction is adopted, as depicted in FIG. 2, in which a plurality of small and substantially similar directional antennas 1' are arranged next to each other in rows without spaces therebetween, such that the extent of their apertures corresponds to that of the large directional antenna 1 of FIG. 1. One row of antenna elements is shown respectively connected to the control means 12. It is to be understood that, although not shown, all antenna elements of all rows are likewise connected to the control means. In order to enable the scanning operation to be carried out over a greater surface area, the arrangement of directional antenna elements in a row 6 is extended, which in the row direction exceeds the dimension of the large single antenna 1 (FIG. 1). In the preferred embodiment there are about 30 directional antenna elements 1' per row 6 having a height of about 30 cm, an aperture per element of about 7.5 cm, an aperture-side width of the flared strip conductors 2', 3' of about 2 cm, and a row length of 60–70 cm. The material used in this case is brass.

Such an arrangement of rows of directional antenna elements is suitable for use as a hand-operated instrument for detecting small objects embedded in the ground, e.g. mines, and in particular, both anti-personnel mines, which are customarily placed directly below the ground surface, and anti-tank mines, which are buried somewhat deeper, as a rule about 20 cm below the ground surface, in connection with which an additional electrical measure is needed, which will be described in detail below.

In accordance with the embodiment of FIG. 2, several, e.g. three, rows 6 are connected to each other such that the overall impression produced is that of a mosaic- or matrix-type arrangement. The free space between the flared ship conductors 2' and 3' is, for reasons of stability, filled with a lightweight, electrically neutral material 7, e.g. foam material. In accordance with a further preferred embodiment (not illustrated), the filler can be eliminated, in which case the directional antenna elements 1' must be fastened to an external mounting support. The aperture-side ends of the flat strips 2', 3' adjoin a layer of absorbing material 11 on both sides of the rows 6 for the purpose of reducing the overall length of the directional antenna elements 1'. The absorbing material 11 is plate-shaped, arranged parallel to the plane of symmetry 13 of the directional antenna elements 1', and a functional component of the directional antenna elements. The result is that the flared strip conductors of adjacent directional antenna elements 1' in a row 6 can be connected to each other by means of attenuators 8. However, such attenuators can be alternatively employed.

The mosaic or matrix-type construction of FIG. 2 as seen from its radiation-side, i.e. its underside, is shown in FIG. 3. When such an instrument comprises only a single row 6, then during searching for objects embedded in the earth the individual directional antenna elements 1' are activated either individually or—for the purpose of increasing the aperture—in groups. If the instrument instead comprises a plurality of rows 6 (as shown in FIG. 3), then entire arrays of such directional antenna elements are activated collectively. For example, the $3\times1$ array indicated by bold lines in the upper left-hand corner of FIG. 3 is activated collectively during detection of anti-personnel mines, whereas the $9\times3$ array, also indicated by bold lines, is activated collectively during detection of anti-tank mines. The invention is not delimited by either the number of clustered directional antenna elements or the direction of pulsing, since basically either row-wise or column-wise pulsing of the antenna elements is feasible.

Figure 4:
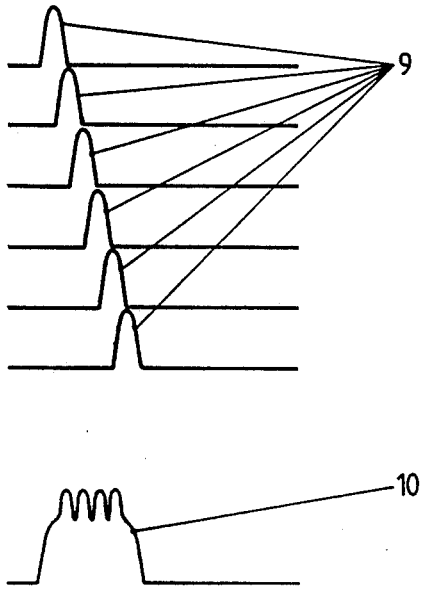
FIG. 4 shows the receiving-side summation operation performed on the signal pulses of the activated antenna elements in the low-frequency antenna according to FIGS. 2 and 3.

In order to achieve a good resolution and in practice obtain the necessary aperture dimensions using the directional antenna elements as described above, above all to enable deep-lying objects to be located in wet ground, the technique illustrated in FIG. 4 should be utilized. In the receiver-side circuitry, which is incorporated in the control means 12 of FIG. 2, delay lines must be provided. A propagation time shift is produced depending on their number and magnitude. The amplitudes of the individual pulses 9 radiated from the directional antenna elements, activated in dependence on the desired aperture dimension, can now be time-shifted and then superimposed to simulate a low-frequency signal 10. In accordance with a variation (not illustrated) of this technique, it is also possible to radiate into the ground a train of superimposed, time-shifted pulses the envelope of which corresponds to a long pulse.

The foregoing description of the preferred embodiment is presented for illustrative purposes only and is not intended to limit the scope of the invention as defined in the appended claims. Modifications may be readily effected by one having ordinary skill in the art without departing from the spirit and scope of the inventive concept herein disclosed.

What is claimed is:

1. A broad-band directional antenna of the horn type having a first plurality of substantially similar directional antenna elements arranged in an array comprising a first row, each antenna element comprising first and second flared strip conductors symmetrically arranged with respect to a plane of symmetry, each flared strip conductor having a base end and an aperture end, said base ends being situated close to each other and said aperture ends being situated at a distance greater than the distance separating said base ends, said base end and corresponding aperture end being connected by a curved portion of said flared strip conductor, said base ends of said first strip conductors being aligned, said base ends of said second strip conductors being aligned, said aperture ends of said first strip conductors being aligned, and said aperture ends of said second strip conductors being aligned, the impedance of said antenna element increasing in the direction of said aperture ends, said first row of antenna elements having first and second absorber plates arranged on either side thereof, said plates being substantially parallel to said plane of symmetry, an edge of said first absorber plate being coupled to each of said first flared strip conductors at said aperture end thereof and an edge of said second absorber plate being coupled to each of said second flared strip conductors at said aperture end thereof.

2. The antenna of claim 1, further comprising means for controlling said antenna elements to produce a received signal which is the sum of a plurality of time-shifted pulses.

3. The antenna of claim 2, further comprising a second plurality of antenna elements arranged in a second row parallel to said first row.

4. The antenna of claim 3, wherein said controlling means activates said antenna elements in groups, each group having at least one antenna element from said first row and at least one antenna element from said second row.

5. The antenna of claim 2, wherein said controlling means comprises a receiving circuit having delay lines for time-shifting received pulses.

6. The antenna of claim 1, further comprising attenuating means arranged between adjacent flared conductors at the aperture ends thereof.

* * * * *